US008051509B2

(12) United States Patent
SiKui et al.

(10) Patent No.: US 8,051,509 B2
(45) Date of Patent: Nov. 8, 2011

(54) HEATED SLEEPING BAG

(75) Inventors: Cai SiKui, Tianjin (CN); Ted Fortuna, Toronto (CA)

(73) Assignee: American Recreation Products, Inc., Boulder, CO (US)

( * ) Notice: Subject to any disclaimer, the term of this patent is extended or adjusted under 35 U.S.C. 154(b) by 0 days.

(21) Appl. No.: 12/511,221

(22) Filed: Jul. 29, 2009

(65) Prior Publication Data

US 2010/0024126 A1 Feb. 4, 2010

Related U.S. Application Data

(60) Provisional application No. 61/084,528, filed on Jul. 29, 2008.

(51) Int. Cl.
*A47G 9/08* (2006.01)

(52) U.S. Cl. ..... 5/413 R; 5/421

(58) Field of Classification Search ..... 5/413 R, 5/421

See application file for complete search history.

(56) References Cited

U.S. PATENT DOCUMENTS

| | | | | |
|---|---|---|---|---|
| 3,380,087 | A * | 4/1968 | Petty et al. | 219/217 |
| 3,427,431 | A * | 2/1969 | Costanzo | 219/212 |
| 5,528,779 | A * | 6/1996 | Lee et al. | 5/413 AM |
| 5,893,991 | A * | 4/1999 | Newell | 219/211 |
| 5,986,243 | A * | 11/1999 | Campf | 219/529 |
| 6,189,487 | B1 * | 2/2001 | Owen et al. | 119/28.5 |
| 6,313,438 | B1 * | 11/2001 | Emerick, Jr. | 219/212 |
| 6,609,935 | B2 | 8/2003 | Huang | |
| 6,646,226 | B1 | 11/2003 | Reitz | |
| 6,916,299 | B2 | 7/2005 | Fang | |
| 7,832,032 | B2 * | 11/2010 | Haislip | 5/413 R |
| 2004/0178186 | A1 | 9/2004 | Lu | |
| 2006/0060576 | A1 * | 3/2006 | Haas et al. | 219/543 |
| 2006/0133064 | A1 | 6/2006 | Lin | |
| 2006/0219283 | A1 | 10/2006 | Chang | |

FOREIGN PATENT DOCUMENTS

| | | | |
|---|---|---|---|
| CN | 100335988 | C | 9/2007 |
| DE | 202005006014 | U1 | 6/2005 |
| GB | 2413935 | B | 2/2008 |
| JP | 2004079560 | A | 3/2004 |
| JP | 2004261493 | A | 9/2004 |

OTHER PUBLICATIONS

Photo of hand warming device, printed from http://perpetualkid.com/productimages/Ig/USBL-0600.jpg, 1 photo, dated Aug. 8, 2007.

"Warmmi USB Heating Knee Pads," printed from http://www.vavolo.com/productdetails.asp.ProductID,3745..htm, 3 pages, dated Aug. 8, 2007.

"USB Heating Blanket," printed from http://usb.brando.com.hk/prod_detail.php?prod_id=00224, 1 page, dated Aug. 8, 2007.

"USB Heating Slippers," printed from http://www.usbgeek.com/prod_detail.php?prod_id=0502, 1 page, dated Aug. 8, 2007.

Geeksuger, "USB," printed from http://geeksugar.com/tags/USB?page=2, 2 pages, dated Aug. 8, 2007.

* cited by examiner

*Primary Examiner* — Michael Trettel
(74) *Attorney, Agent, or Firm* — Senniger Powers LLP

(57) ABSTRACT

A sleeping bag generally comprises a shell including an inner layer defining an interior space for a user of the sleeping bag, and an outer layer defining an exterior surface of the bag. A heating pad pocket is on the inner layer. A heating pad is disposed in the pocket and retained therein for radiating heat toward the user.

13 Claims, 6 Drawing Sheets

HEATED SLEEPING BAG

FIELD OF THE INVENTION

The present invention generally relates to a heated sleeping bag.

SUMMARY OF THE INVENTION

In one aspect, a sleeping bag generally comprises a shell including an inner layer defining an interior space for a user of the sleeping bag, and an outer layer defining an exterior surface of the bag. A heating pad pocket is on the inner layer. A heating pad is disposed in the pocket and retained therein for radiating heat toward the user.

In another aspect, a sleeping bag generally comprises a shell including an inner layer defining an interior space for a user of the sleeping bag, and an outer layer defining an exterior surface of the bag. A heating pad pocket is secured to the shell on the inner layer. The pocket is sized and shaped to receive and retain a heating pad therein.

BRIEF DESCRIPTION OF THE DRAWINGS

Corresponding reference characters indicate corresponding parts throughout the drawings.

DESCRIPTION OF THE DRAWINGS

Figure 1:
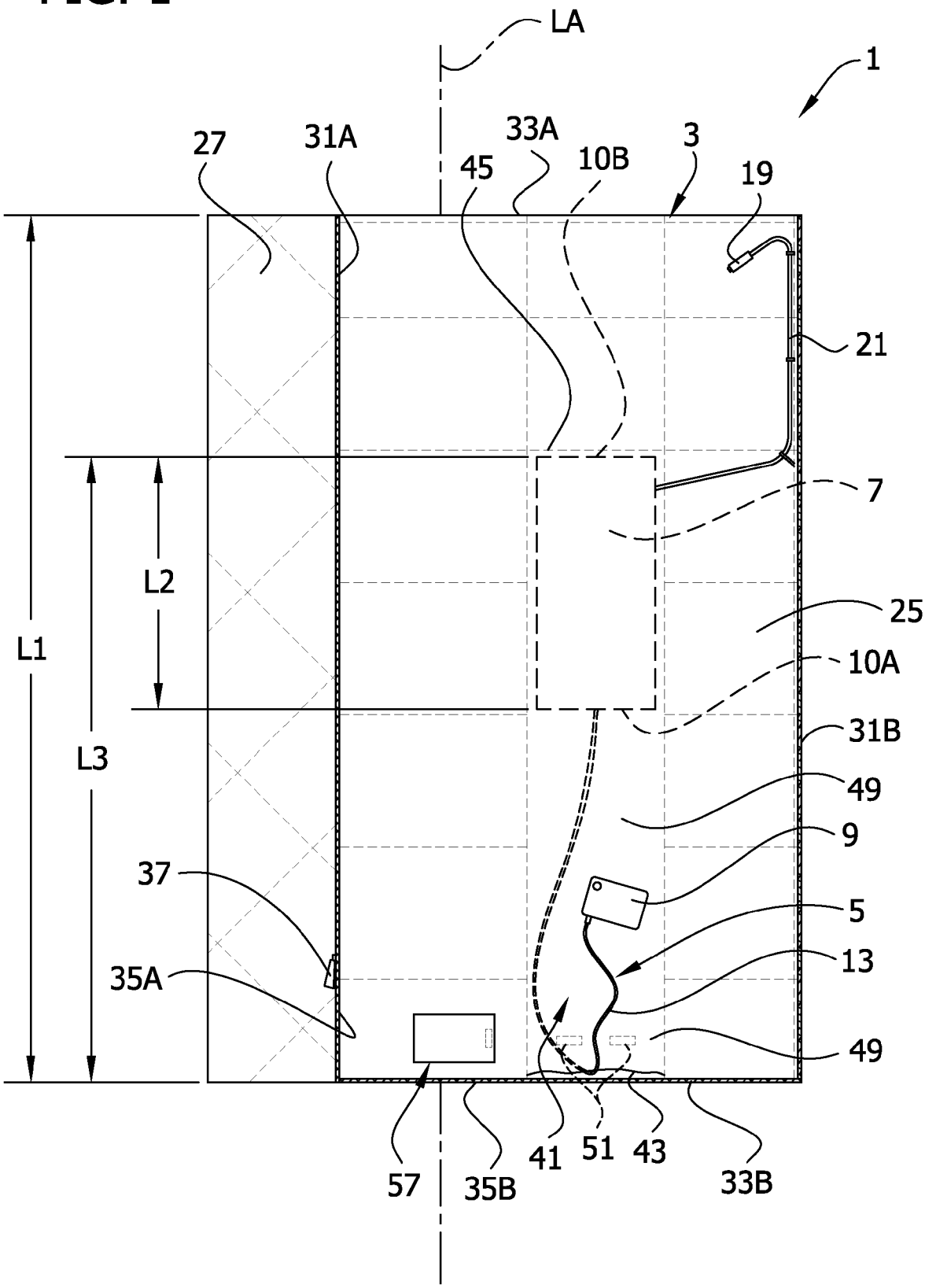
FIG. 1 is a top plan of one embodiment of a sleeping bag including a heating system, the sleeping bag being in an open configuration.
Figure 2:
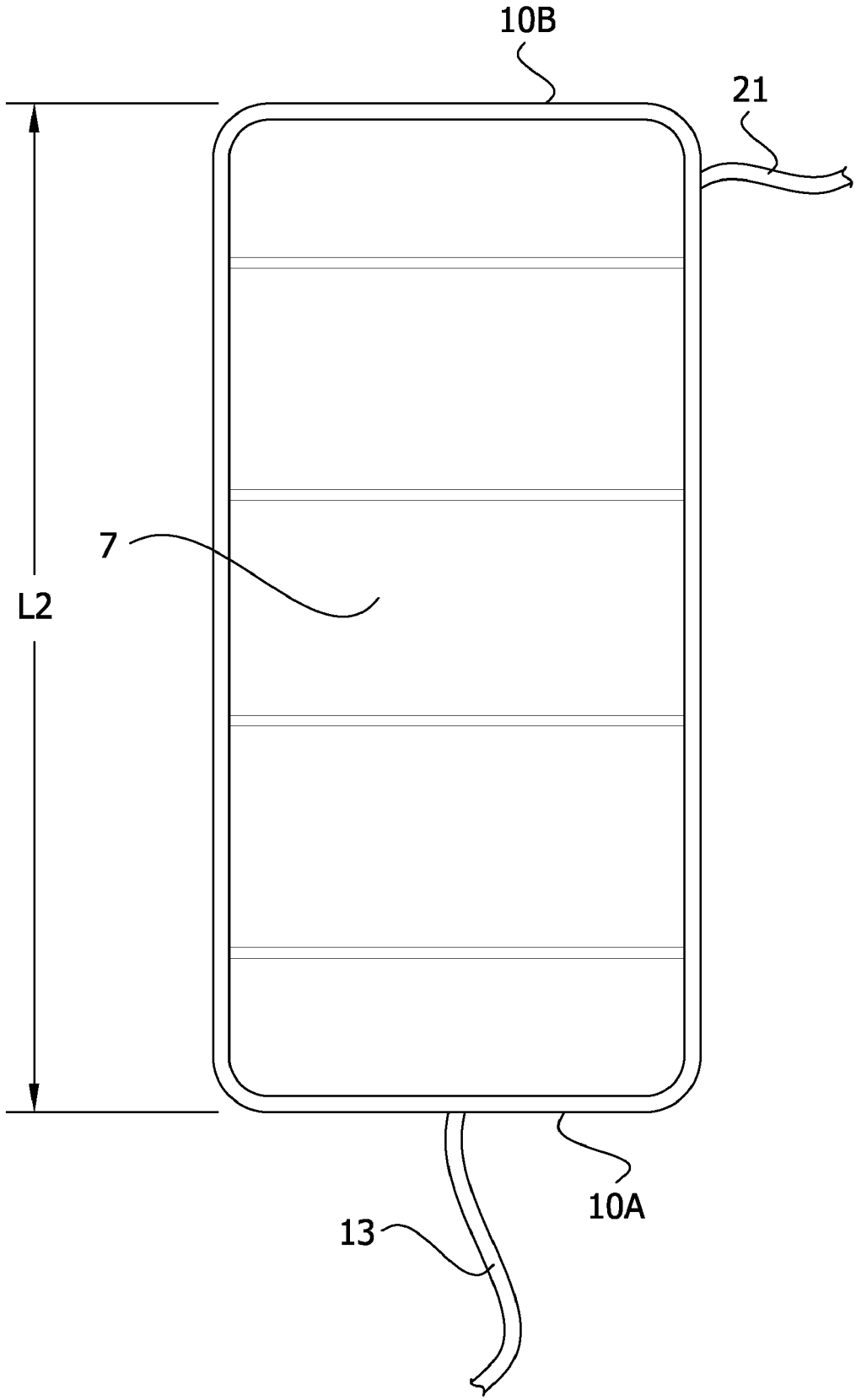
FIG. 2 is a top plan of a heating pad of the heating system.

Referring now to the drawings and in particular to FIGS. 1-6, an embodiment of a sleeping bag of the present invention is designated in its entirety by the reference number 1. In general, the sleeping bag comprises a shell 3 and a heating system 5 removably secured to the shell to provide warmth to a user of the sleeping bag. Referring particularly to FIGS. 1 and 2, the heating system 5 includes a PTC heating pad 7, the structure and operation of which is generally known in the art. Briefly, the PTC heating pad 7 includes a positive temperature coefficient (PTC) resistance material (not shown) inside the pad. The PTC resistance material is resistively heated by passing an electrical current through it. Due to the nature of the material, the temperature of the heating pad will not exceed a predetermined temperature. Other types of heating pads, such as a heating pad with carbon fiber resistive material, are within the scope of the invention.

Figure 3:
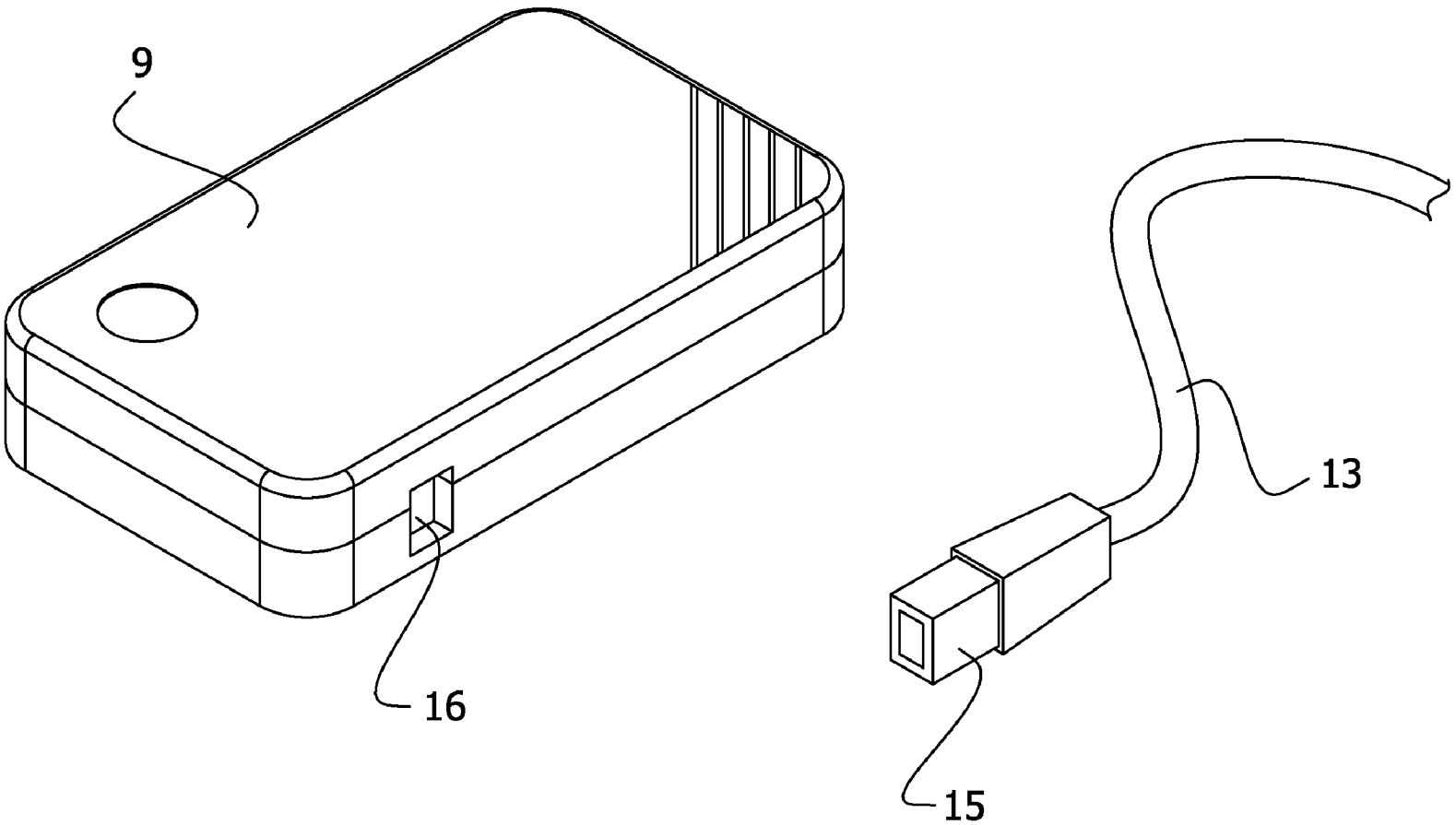
FIG. 3 is an enlarged, fragmentary perspective of a battery and associated cord of the heating system.

Referring to FIGS. 1 and 3, a battery 9 of the heating system 5 supplies power, i.e., electrical current, to the heating pad 7 to heat the pad. The battery 9 is electrically connected to the heating pad 7 by a power cord 13, which extends outward from the pad generally adjacent to a lower edge 10A of the pad. In the illustrated embodiment (FIG. 3), one end of the power cord 13 includes a first connector 15 that is releasably connected to a USB outlet port 16 of the battery 9. The power cord 13 may be electrically connected to the battery 9 in other ways, such as using other types of outlet ports. The battery 9 is a rechargeable battery, such as polymer lithium battery, that may be recharged by connecting the battery to a charger, such as an AC charger (not shown) that is connected to a 120 V source. Other ways of recharging the battery 9 are within the scope of the invention.

Figure 4:
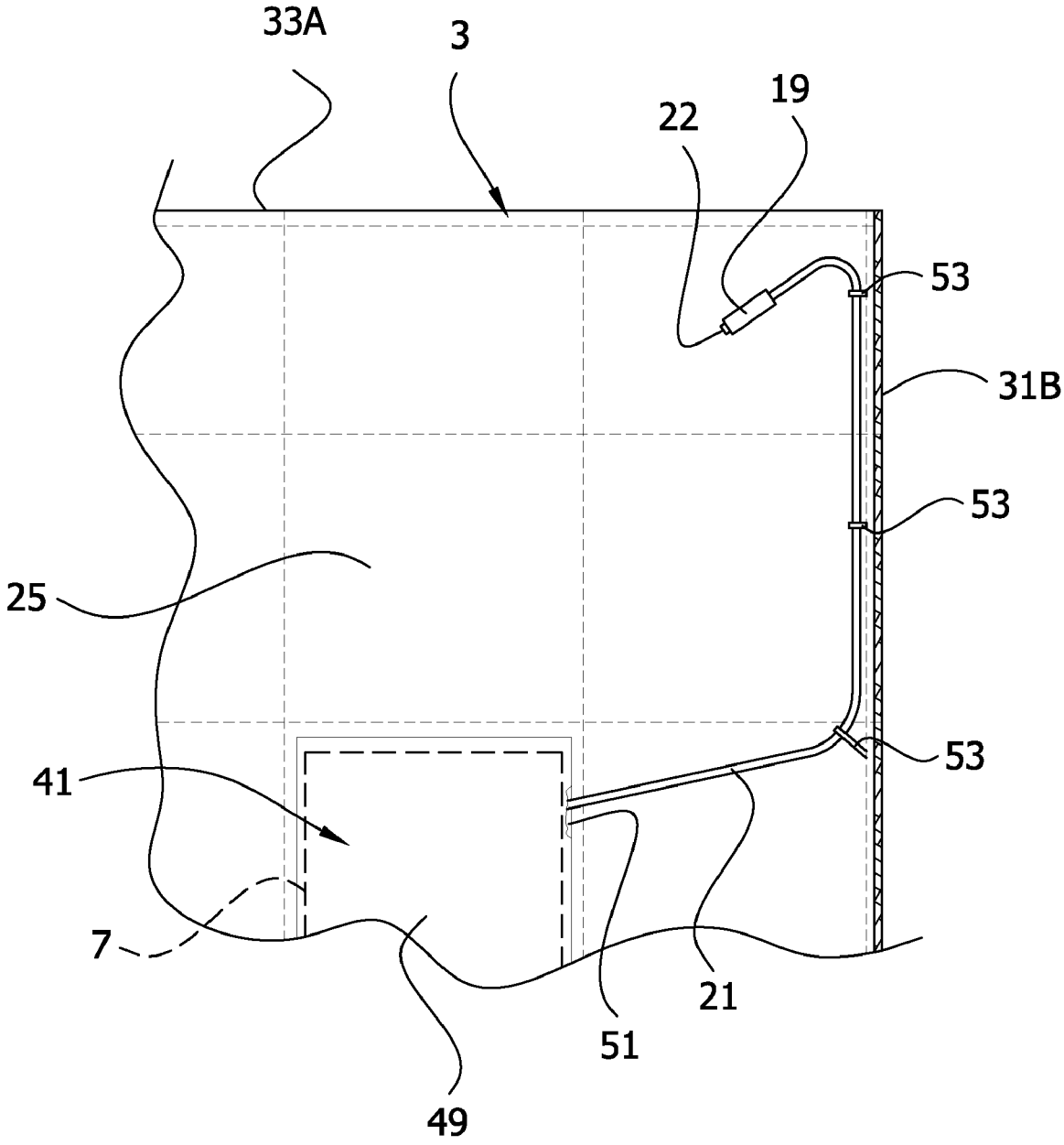
FIG. 4 is an enlarged, fragmentary view of the sleeping bag in FIG. 1 showing a controller and an associated cord.

Referring to FIGS. 1, 2 and 4, a controller 19 is electrically connected to the heating pad 7 by a cord 21 extending outward from the heating pad generally adjacent to an upper edge 10B of the heating pad. The controller 19 includes an on/off switch to regulate the flow of current from the battery 9 to the PTC heating element of the pad 7. A push button 22 on the controller 19 actuates opening and closing of the switch to respectively prevent current from flowing from the battery 9 to the PTC heating element and allow current to flow from the battery to the PTC heating element. The controller 19 may include other features and operations without departing from the scope of the invention. For example, the amount of current flowing to the PTC heating element may be adjustable to control the temperature of the PTC heating element.

Figure 6:
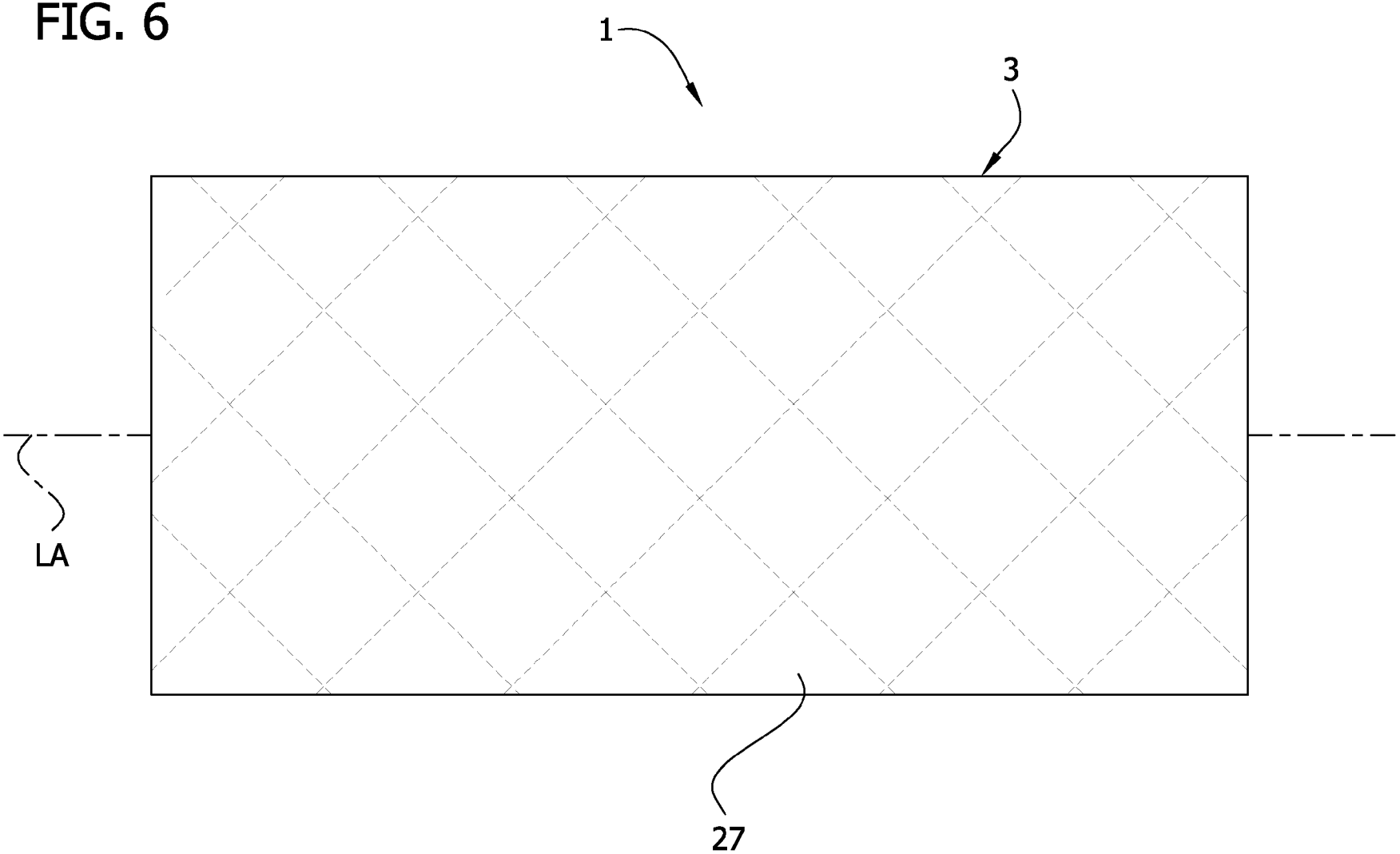
FIG. 6 is a top plan of the sleeping bag of FIG. 1 in a closed configuration.

The shell 3 of the sleeping bag is configurable between an open configuration in which the shell is generally planar and square-shaped (FIG. 1) and a closed configuration in which the shell has a generally flattened tube shape with a longitudinal axis LA (FIG. 6). The shell 3 includes an inner layer 25, an outer layer 27 and insulation material (not shown) disposed between the inner and outer layers. The inner and outer layers 25, 27, respectively, are generally superposed and are secured together along their peripheral edges, which include left and right peripheral edges 3 1A, 3 1B, respectively, and top and bottom peripheral edges 33A, 33B, respectively. (The margin of the left peripheral edge 31A is folded over in FIG. 1.) The insulation material between the inner and outer layers 15, 17, provides warmth and softness to the bag 1.

As shown best in FIG. 1, a first zipper track 35A runs along the left peripheral edge 31A and a contiguous half of the bottom peripheral edge 33B to the longitudinal axis LA of the shell, while a second, complementary zipper track 35B runs along the right peripheral edge 31B and a contiguous other half of the bottom peripheral edge to the longitudinal axis of the shell. A zipper slide 37 slides on one of the tracks 35A, 35B. To configure the shell 3 in its closed configuration, the shell is folded generally in half along a longitudinal centerline extending between the top and bottom peripheral edges 33A, 33B. The left and right peripheral edges 31A, 31B, respectively, and the halves of the bottom peripheral edge 33B are secured together using the zipper so that the outer layer 27 defines an exterior surface of the shell and the inner layer 25 defines an interior surface surrounding the user and defining an interior space for the user. The folded top peripheral edge 33A defines an opening of the interior space.

Referring to FIGS. 1, 6 and 7, an elongate heating pad pocket, generally indicated at 41 (broadly, a first pocket), is provided on the inner layer 25 of the shell 3 for removably retaining the heating pad 7 therein. The heating pad pocket 41 extends longitudinally along the shell 3 and has a closable open end 43 generally adjacent to the bottom peripheral edge 33B of the shell and a closed end 45 generally adjacent to and spaced away from the top peripheral edge 33A. In one embodiment, the heating pad pocket 41 has a length L3 extending along at least 50% of the length L1 of the sleeping bag 1, and in the illustrated embodiment, extending along about 70% of the length of the sleeping bag. It is contemplated that the sleeping bag may have more than one heating pad pocket. It is also contemplated that the heating pad pocket (s) may extend generally transversely across the shell or may extend in other directions. In a particular embodiment, a pair of spaced apart, generally parallel heating pad pockets extends generally transversely across the shell.

In the illustrated embodiment, the heating pad pocket 41 comprises a generally rectangular layer 49 that is superimposed on and secured to the inner layer 25, such as by stitching around the perimeter of the rectangular layer. The pocket 41 may be of other shapes and may be formed in other ways without departing from the scope of the present invention. The closable open end 43 of the pocket 41 allows the heating pad 7 to be selectively inserted lengthwise into the pocket to a desired position and selectively removed therefrom. The heating pad 7 is snugly fit in the pocket 41 so that side edges of the pad engage respective internal sides of the pocket. This snug fit generally retains the heating pad 7 in the desired position in the pocket 41. The closable open end 43 is repeatedly closable, as by way of opposing, complementary hook and look fasteners 51 secured to the inner layer 25 and the rectangular layer 49 generally adjacent to the open end of the pocket 41. The open end 43 of the pocket 41 may be repeatedly closable in other ways without departing from the scope of the present invention.

As shown in FIG. 1, the length L3 of the heating pad pocket 41 is generally greater than the length L2 of the heating pad 7, and in one embodiment, the length of the heating pad pocket is greater than or equal to about twice the length of the heating pad. More specifically, the relative lengths of the heating pad pocket 41 and the heating pad 7 are such that the longitudinal location of the heating pad in the pocket may be adjusted so that the heating pad is disposed in either a top portion or zone of the pocket (FIGS. 1 and 4), with the top edge 10B of the heating pad generally adjacent or close to the closed end 45 of the pocket, or a bottom portion or zone of the pocket, with the bottom edge 10A of the heating pad generally adjacent or close to the closable, open end 43 of the pocket (FIG. 5), or an intermediate portion between the top and bottom portions. The top portion of the heating pad pocket 41 is disposed generally adjacent to a torso of a user in use, and the bottom portion of the heating pad pocket is disposed generally adjacent to feet of a user in use. Thus, when the heating pad 7 is in the top portion of the pocket 41, heat radiating from the heating pad is directed toward the torso of the user, and when the heating pad is in the bottom portion of the pocket, heat radiating from the heating pad is directed toward the feet of the user. The user can also move heating pad to the intermediate portion of the heating pad pocket 41 to direct heat toward a location on his or her body between his or her torso and feet.

Referring back to FIG. 4, when the heating pad 7 is received in the heating pad pocket 41, the controller cord 21 connecting the switch of the controller 19 and the heating pad 7 extends through an opening 51 adjacent to the top portion of the pocket. The cord 21 is threaded through a series of elastic loops 53 (broadly, a securement device) that are secured to the inner layer 25 generally adjacent to the right peripheral edge 31B of the shell 3. The series of loops 53 extends from generally adjacent the top portion of the heating pad pocket 41 to generally adjacent the top peripheral edge 33A of the shell 3. The loops 53 retain the cord 21 in close proximity to the inner layer 25 and position the controller 19 generally adjacent to the top peripheral edge 33A of the shell 3 for easy, repetitive access by the user and to prevent the controller from inadvertently moving toward the bottom of the sleeping bag 1 where it is not conveniently accessible to the user.

Figure 5:
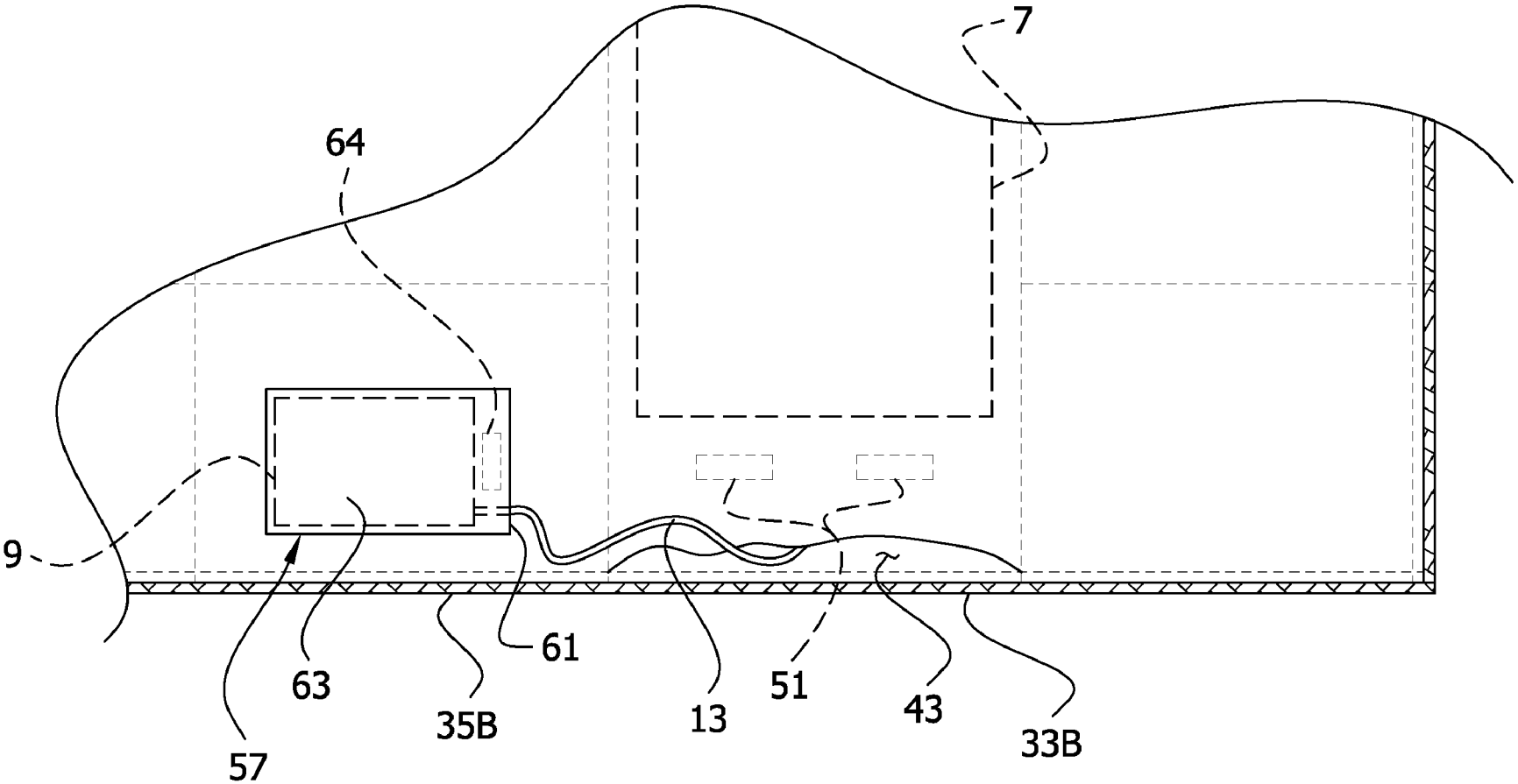
FIG. 5 is an enlarged, fragmentary view of the sleeping bag in FIG. 1 showing the battery and an associated cord.

Referring to FIGS. 1 and 5, a battery pocket, generally indicated at 57, is also provided on the inner layer 25 of the shell 3 for retaining the battery 9 of the heating system 5. The battery pocket 57 is located generally adjacent to the bottom peripheral edge 33B of the shell 3 and extends generally transverse to the longitudinal axis LA of the shell. The battery pocket 57 has a closable open end 61 (FIG. 5) generally adjacent to the closable open end 43 of the heating pad pocket 41. In the illustrated embodiment, the battery pocket 57 comprises a superposed, generally rectangular layer 63 that is secured to the inner layer 25 by stitching extending partially around the perimeter of the rectangular layer. The battery 57 pocket may have other shapes and may be formed in other ways without departing from the scope of the present invention. The closable open end 61 of the battery pocket 57 is repeatedly closable, as by way of complementary hook and look fasteners 64 (FIG. 5) secured to the inner layer 25 and the rectangular layer 63 generally adjacent to the open end of the pocket. The closable open end 61 of the battery pocket 57 may be closable in other ways without departing from the scope of the present invention. As shown in FIG. 9, the power cord 13 connecting the battery 9 to the heating pad 7 extends through the closed open ends 61, 43 of the respective battery pocket 57 and heating pad pocket 41. It is understood that the sleeping bag may not have a battery pocket. For example, the sleeping bag would not need a separate battery pocket if the battery of the heating system was formed integrally with the heating pad.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A sleeping bag comprising:

a shell including an inner layer defining an interior space for a user of the sleeping bag, and an outer layer defining an exterior surface of the bag;

a heating pad pocket on the inner layer;

a heating pad disposed in the pocket and retained therein for radiating heat toward the user;

wherein the heating pad pocket has a length extending along at least 50% of a length of the sleeping bag;

wherein the heating pad has a length less than the length of the heating pad pocket whereby the heating pad is movable within the heating pad pocket to selectively adjust a longitudinal position of the heating pad with respect to the sleeping bag; and wherein the heating pad pocket has a closable open longitudinal end generally adjacent to a bottom peripheral edge of the shell.

2. A sleeping bag as set forth in claim 1 further comprising:

a battery electrically connected to the heating pad for supplying power to the heating pad; and a battery pocket on the shell, the battery being retained in the pocket.

3. A sleeping bag as set forth in claim 2 wherein the battery is removable from the battery pocket.

4. A sleeping bag as set forth in claim 3 wherein the battery pocket has a closable open end for removing the battery.

5. A sleeping bag as set forth in claim 1 further comprising a controller accessible outside the heating pad pocket and electrically connected to the heating pad for turning the heating pad on and off.

6. A sleeping bag as set forth in claim 5 further comprising:

a cord extending outside the heating pad pocket and electrically connecting the controller to the heating pad; and a securement device securing the cord to the shell of the sleeping bag.

7. A sleeping bag comprising:

a shell including an inner layer defining an interior space for a user of the sleeping bag, and an outer layer defining an exterior surface of the bag;

a heating pad pocket on the inner layer;

a heating pad disposed in the pocket and retained therein for radiating heat toward the user;

wherein the heating pad pocket has a length extending along at least 50% of a length of the sleeping bag;

a controller accessible outside the heating pad pocket and electrically connected to the heating pad for turning the heating pad on and off;

a cord extending outside the heating pad pocket and electrically connecting the controller to the heating pad;

a securement device securing the cord to the shell of the sleeping bag; and wherein the securement device includes at least one loop through which the cord is threaded.

8. A sleeping bag as set forth in claim 7 wherein said at least one loop comprises a plurality of elastic loops secured to the inner layer of the shell generally adjacent to one of a left and right peripheral edge of the shell.

9. A sleeping bag as set forth in claim 7 further comprising:

a battery electrically connected to the heating pad for supplying power to the heating pad; and a battery pocket on the shell, the battery being retained in the pocket.

10. A sleeping bag as set forth in claim 1 wherein the heating pad pocket has a top portion disposed generally adjacent to a torso of a user in use for positioning the heating pad generally adjacent to the torso of the user, and a bottom portion disposed generally adjacent to feet of a user in use for positioning the heating pad generally adjacent to the feet of the user.

11. A sleeping bag comprising:

a shell including an inner layer defining an interior space for a user of the sleeping bag, and an outer layer defining an exterior surface of the bag;

a heating pad pocket secured to the shell on the inner layer, the pocket being sized and shaped to receive and retain a heating pad therein;

a battery pocket sized and shaped to receive and retain a battery electrically connected to the heating pad; and further comprising at least one loop for securing a cord electrically connected to the heating pad to the inner layer of the shell.

12. A sleeping bag as set forth in claim 11 wherein the heating pad pocket has a top portion disposed generally adjacent to a torso of a user in use for positioning the heating pad generally adjacent to the torso of the user, and a bottom portion disposed generally adjacent to feet of a user in use for positioning the heating pad generally adjacent to the feet of the user, the bottom portion including a closable open end generally adjacent to a bottom peripheral edge of the shell.

13. A sleeping bag as set forth in claim 11 wherein the heating pad pocket has an intermediate portion disposed generally between the top portion and the bottom portion for positioning the heating pad generally between the torso and the feet of the user during use.

* * * * *